US006585335B2

(12) United States Patent
Hwang et al.

(10) Patent No.: US 6,585,335 B2
(45) Date of Patent: Jul. 1, 2003

(54) REAR-SECTION BOLT LOCK STRUCTURE OF A SLIDE

(75) Inventors: Shih-Long Hwang, Kaohsiung Hsien (TW); Ken-Ching Chen, Kaohsiung Hsien (TW); Chun-Chiang Wang, Kaoshsiung Hsien (TW)

(73) Assignee: King Slide Works Co., Ltd. (TW)

( * ) Notice: Subject to any disclaimer, the term of this patent is extended or adjusted under 35 U.S.C. 154(b) by 0 days.

(21) Appl. No.: 09/964,348

(22) Filed: Sep. 28, 2001

(65) Prior Publication Data

US 2003/0062812 A1 Apr. 3, 2003

(51) Int. Cl.[7] ..... A47B 88/00
(52) U.S. Cl. ..... 312/333; 312/334.46; 384/21
(58) Field of Search ..... 312/333, 334.44, 312/334.45, 334.46, 334.8, 334.11, 334.17; 384/21

(56) References Cited

U.S. PATENT DOCUMENTS

| | | | | |
|---|---|---|---|---|
| 3,141,714 A | * | 7/1964 | Valitus | 312/334.46 |
| 3,650,578 A | * | 3/1972 | Del Vecchio et al. | 312/334.46 |
| 3,801,166 A | * | 4/1974 | York | 312/334.44 |
| 5,169,238 A | * | 12/1992 | Schenk | 384/21 |
| 5,309,323 A | * | 5/1994 | Gray et al. | 312/334.44 |
| 5,722,750 A | * | 3/1998 | Chu | 312/334.46 |
| 5,851,059 A | * | 12/1998 | Cirocco | 312/333 |
| 6,350,001 B1 | * | 2/2002 | Chu | 312/334.44 |
| 6,375,290 B1 | * | 4/2002 | Lin et al. | 312/334.46 |
| 6,390,575 B1 | * | 5/2002 | Chen et al. | 312/334.46 |
| 6,450,600 B1 | * | 9/2002 | Chen et al. | 312/334.46 |
| 6,464,311 B2 | * | 10/2002 | Liang et al. | 312/334.46 |

FOREIGN PATENT DOCUMENTS

| | | | | |
|---|---|---|---|---|
| EP | 107525 | * | 5/1984 | 312/333 |
| JP | 07039430 | * | 2/1995 | 312/334.44 |

* cited by examiner

*Primary Examiner*—Lanna Mai
*Assistant Examiner*—Hahn V. Tran
(74) *Attorney, Agent, or Firm*—Bacon & Thomas, PLLC

(57) ABSTRACT

A rear-section bolt lock structure of a slide includes an outer rail provided with a stop plate. An intermediate rail is moved in the outer rail, and provided with a locking block rested on the stop block of the outer rail. The intermediate rail is combined with a positioning plate which is provided with at least one positioning leg locked in the locking hole of the outer rail. A movable plate is movably mounted between the intermediate rail and the positioning plate, and provided with at least one lug locked in the locking hole of the positioning plate. An inner rail is moved in the intermediate rail, and provided with a stop end edge that may press the wing of the movable plate. The inner rail is provided with a locking member rested on the stop blocks of the intermediate rail.

3 Claims, 5 Drawing Sheets

REAR-SECTION BOLT LOCK STRUCTURE OF A SLIDE

BACKGROUND OF THE INVENTION

1. Field of the Invention

The present invention relates to a rear-section bolt lock structure of a slide, and more particularly to a slide containing an outer rail, an intermediate rail, and an inner rail, wherein when the inner rail is pulled outward to a fully expanded position, the intermediate rail may be retained at a locked position.

2. Description of the Related Art

A slide is usually used to connect and guide two articles that may be moved relative to each other, such as a cupboard and its drawer or a computer table and its keyboard support rack.

A conventional three-stage type slide generally comprises an outer rail, an intermediate rail, and an inner rail. For example, the outer rail may be fixed in a cupboard, the inner rail may be fixed at two sides of the drawer of the cupboard, and the intermediate rail is received in the outer rail to support the inner rail. The inner rail, the intermediate rail and the outer rail may be coupled with each other by such as the design of a ball bearing, and the inner rail and the intermediate rail may be moved in the axial direction of the outer rail reciprocally. Thus, the drawer may be pulled outward from or retracted into the cupboard freely by the slide.

The conventional three-stage type slide containing the inner rail, the intermediate rail and the outer rail needs to have the design of a bolt lock, so that when the inner rail is moved with the drawer to be pulled outward from the cupboard and moved toward the distal end of the intermediate rail to a usage position, the inner rail may be stopped at the distal end of the outer rail, thereby maintaining the drawer at the usage position temporarily. The bolt lock has to possess the function of detaching the drawer, so that the drawer and the inner rail may be detached from and retracted into the cupboard.

A conventional three-stage type drawer slide structure in accordance with the prior art shown in FIG. 7 primarily comprises an outer rail 91, an intermediate rail 92, and an inner rail 93. Multiple rolling balls 94 are mounted between the intermediate rail 92 and the inner rail 93, so that the inner rail 93 may slide along the intermediate rail 92 conveniently. At the same time, for facilitating the mounting work of the conventional three-stage type drawer slide structure, the inner rail 93 is provided with a locking member 95 which has legs 96 that may be opened and closed elastically. The intermediate rail 92 is provided with a catch 97 protruded with a stop 971. After the inner rail 93 is fitted in the intermediate rail 92 and when the inner rail 93 is pulled outward, the lug 951 of the locking member 95 is locked with the stop 971 of the catch 97, thereby preventing the inner rail 93 from detaching from the intermediate rail 92. Thus, the lug 951 of the locking member 95 and the stop 971 of the catch 97 may form a positioning structure to prevent outward detachment.

When the conventional three-stage type drawer slide structure is assembled and dismantled, the user needs to press the locking member 95 with his one finger. However, the space between the outer rail 91, the intermediate rail 92, and the inner rail 93 is very small, so that the user finger is easily clipped and injured.

SUMMARY OF THE INVENTION

The primary objective of the present invention is to provide a rear-section bolt lock structure of a slide, wherein when the inner rail is pulled outward to a fully expanded position, the intermediate rail may be retained at a locked position. In addition, the slide may be expanded and retracted easily and conveniently.

In accordance with the present invention, there is provided a rear-section bolt lock structure of a slide, comprising:

an outer rail, provided with upper and lower lips, and the outer rail having one end provided with a stop plate, the outer rail provided with locking holes and a stop block;

an intermediate rail, provided with upper and lower lips received and moved in the lips of the outer rail, one end of the intermediate rail provided with a locking block that may be rested on the stop block of the outer rail, the intermediate rail combined with a positioning plate by positioning members, the positioning plate provided with at least one positioning leg that may be locked in the locking hole of the outer rail, a movable plate movably mounted between the intermediate rail and the positioning plate, one end of the movable plate provided with at least one lug that may be locked in the locking hole of the positioning plate, the other end of the movable plate provided with at least one wing, the intermediate rail provided with stop blocks; and an inner rail, provided with upper and lower lips received and moved in the lips of the intermediate rail, one end of the inner rail provided with a stop end edge that may press the wing of the movable plate of the intermediate rail, the inner rail provided with a locking member that may rested on the stop blocks of the intermediate rail.

Further benefits and advantages of the present invention will become apparent after a careful reading of the detailed description with appropriate reference to the accompanying drawings.

DETAILED DESCRIPTION OF THE PREFERRED EMBODIMENTS

Figure 1:
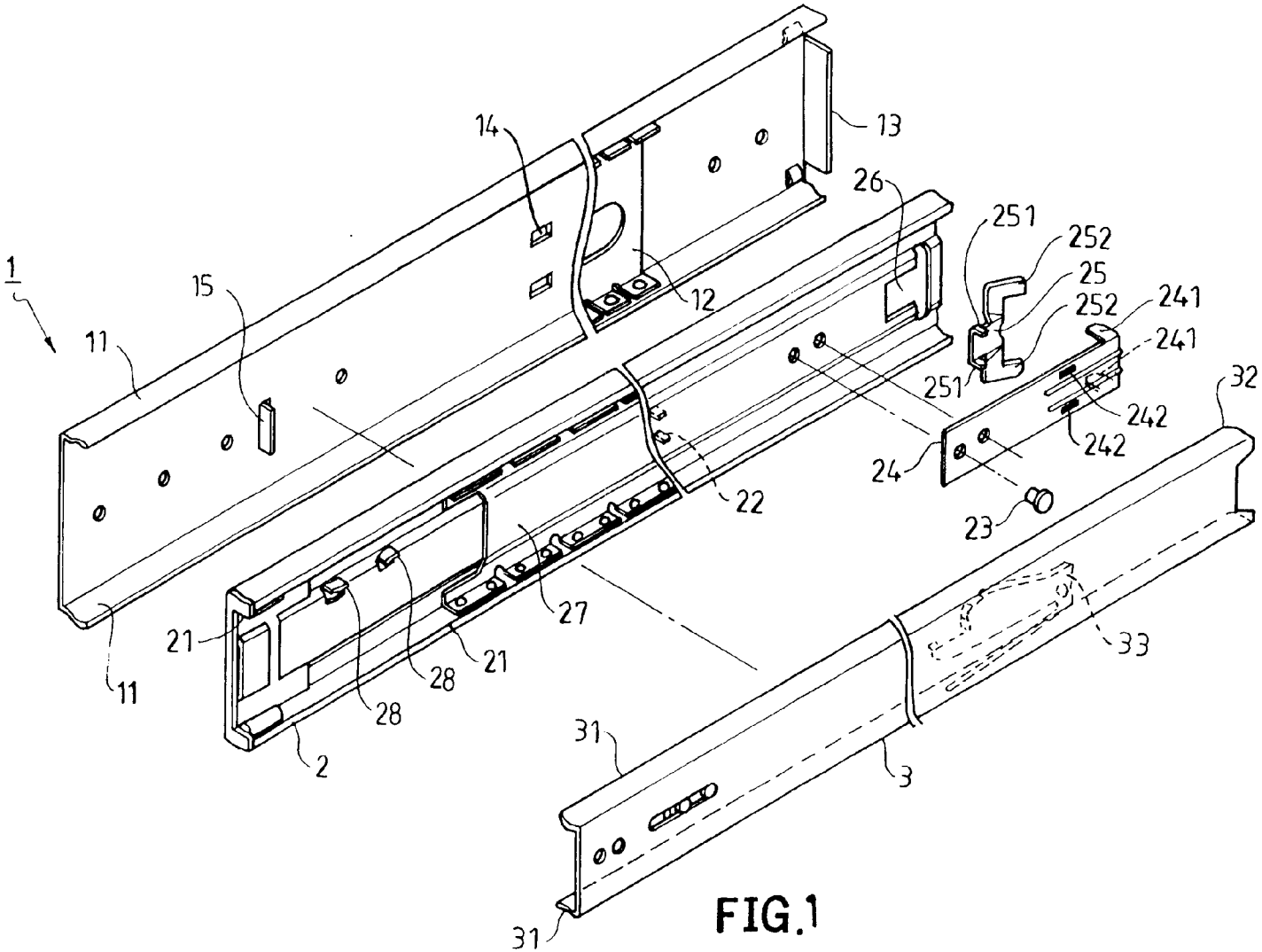
FIG. 1 is an exploded perspective view of a rear-section bolt lock structure of a slide in accordance with a preferred embodiment of the present invention.

Referring to the drawings and initially to FIG. 1, a slide in accordance with a preferred embodiment of the present invention comprises an outer rail 1, an intermediate rail 2, and an inner rail 3.

The top and bottom end of the outer rail 1 have lips 11, so that the inner rail 3 may be received and moved between the lips 11. A slide aid member 12 is mounted between the outer rail 1 and the intermediate rail 2. In the preferred embodiment of the present invention, the slide aid member 12 may be a ball such as a conventional steel ball, thereby facilitating the sliding movement between the outer rail 1 and the intermediate rail 2. One end of the outer rail 1 is provided with a stop plate 13, thereby preventing detachment of the intermediate rail 2. The outer rail 1 is provided with locking holes 14 and a stop block 15.

The intermediate rail 2 may be received and moved between the lips 11 of the outer rail 1. The intermediate rail 2 is provided with lips 21 to align with the lips 11 of the outer rail 1. The slide aid member 12 is mounted between the two lips 11 and 21, thereby facilitating the sliding movement between the outer rail 1 and the intermediate rail 2. The intermediate rail 2 is provided with a locking block 22 that may be locked with the stop block 15 of the outer rail 1, thereby stopping movement of the intermediate rail 2. One end of the intermediate rail 2 is combined with a positioning plate 24 and a movable plate 25 by positioning members 23. The positioning plate 24 is provided with at least one positioning leg 241 that may be locked in the locking hole 14 of the outer rail 1, and the positioning plate 24 is provided with at least one locking hole 242. The movable plate 25 is substantially V-shaped, and is movably mounted between the intermediate rail 2 and the positioning plate 24. One end of the movable plate 25 is provided with at least one lug 251 that may be locked in the locking hole 242 of the positioning plate 24 so as to prevent detachment of the movable plate 25. The other end of the movable plate 25 is provided with at least one oblique protruded wing 252 that may be pressed by the inner rail 3. When the wing 252 of the movable plate 25 is pressed by the inner rail 3, the lug 251 of the movable plate 25 may push the positioning plate 24, so that the positioning leg 241 of the positioning plate 24 may detach from the locking hole 14 of the outer rail 1.

The top and bottom end of the inner rail 3 are provided with lips 31 that are placed in the two lips 21 of the intermediate rail 2. A slide aid member 27 is mounted between the inner rail 3 and the intermediate rail 2, thereby facilitating the sliding movement of the inner rail 3. One end of the inner rail 3 is formed with a stop end edge 32 that may press the wing 252 of the movable plate 25. The inner rail 3 is provided with a locking member 33 that may be locked with stop blocks 28 provide by the intermediate rail 2, thereby limiting and preventing the inner rail 3 from detaching from the intermediate rail 2.

Figure 2:
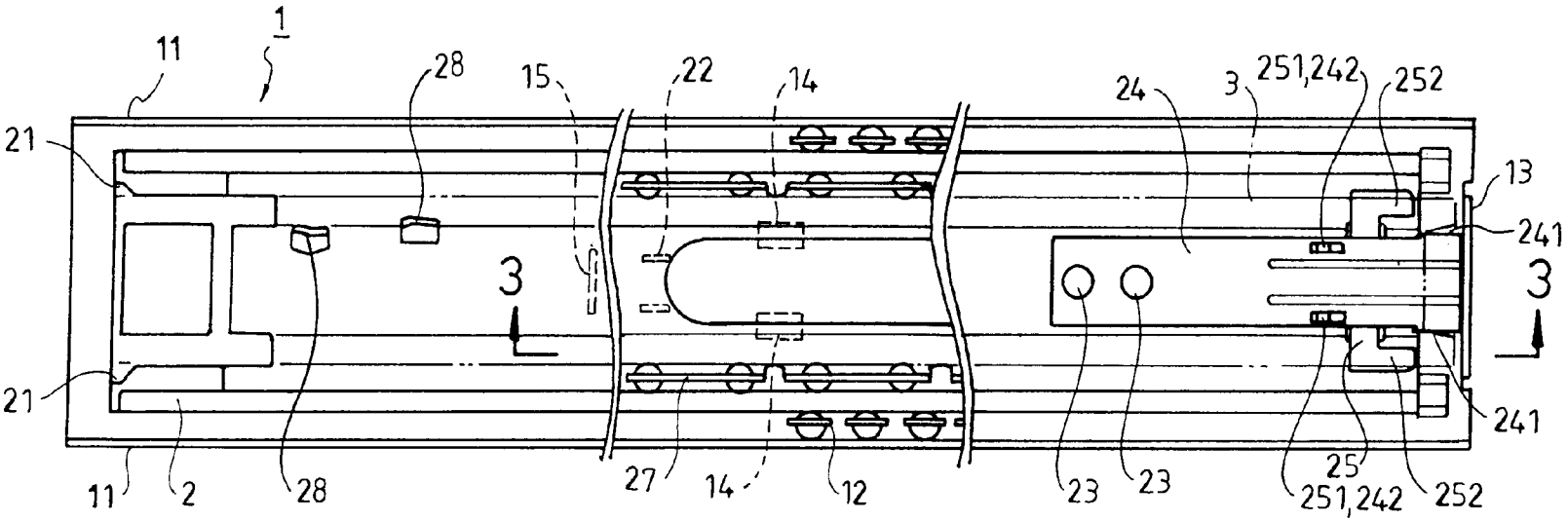
FIG. 2 is a front plan assembly view of the rear-section bolt lock structure of a slide as shown in FIG. 1.
Figure 3:
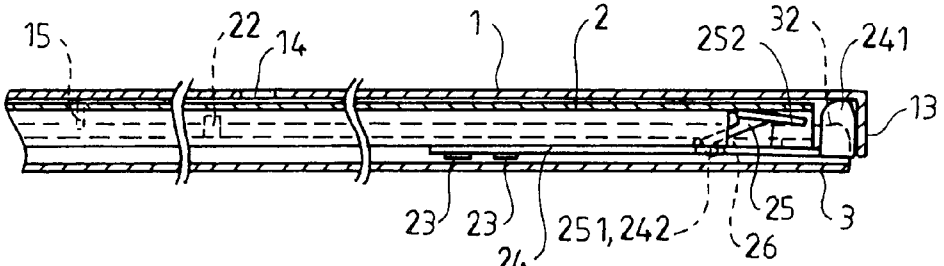
FIG. 3 is a cross-sectional view of the rear-section bolt lock structure of a slide taken along line 3—3 as shown in FIG. 2.

Referring to FIGS. 2 and 3, the slide in accordance with the present invention is assembled to form a smaller length. At this time, the stop end edge 32 of the inner rail 3 presses the wing 252 of the movable plate 25. Thus, the lug 251 of the movable plate 25 is rested on the positioning plate 24, so that the positioning leg 241 of the positioning plate 24 is rested on the inner surface of the outer rail 1.

Figure 4:
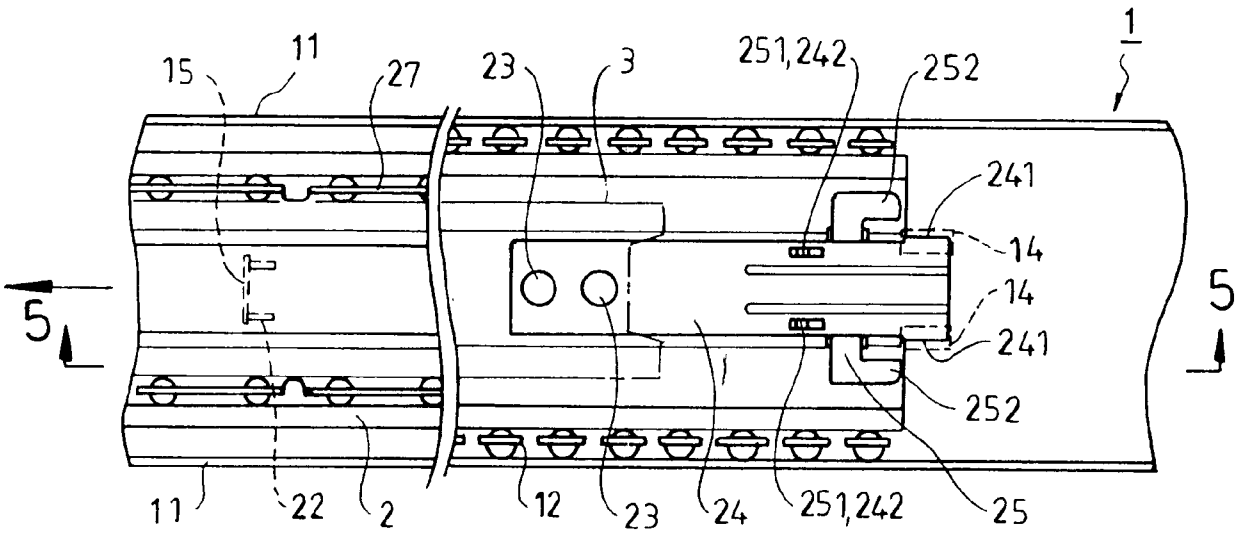
FIG. 4 is a front plan assembly view of the rear-section bolt lock structure of a slide as shown in FIG. 1.
Figure 5:
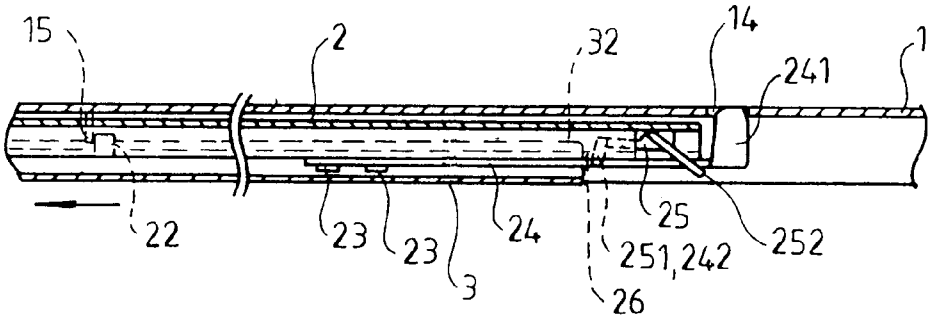
FIG. 5 is a cross-sectional view of the rear-section bolt lock structure of a slide taken along line 5—5 as shown in FIG. 4.

Referring to FIGS. 4 and 5, the three-stage type slide in accordance with the present invention is pulled to have a greater length. The stop end edge 32 of the inner rail 3 presses the wing 252 of the movable plate 25. Thus, when the inner rail 3 is pulled relative to the outer rail 1 to increase the length, the intermediate rail 2 is moved with the inner rail 3 at the same time. When the locking block 22 of the intermediate rail 2 is rested on the stop block 15 of the outer rail 1, movement of the intermediate rail 2 is stopped, and the inner rail 3 may continue its pulling action relative to the outer rail 1. At this time, the stop end edge 32 of the inner rail 3 no longer presses the wing 252 of the movable plate 25. Thus, that the positioning leg 241 of the positioning plate 24 may be locked into the locking hole 14 of the outer rail 1 by the elastic force of the positioning plate 24, so that the intermediate rail 2 may be stopped at a fixed point, until the locking member 33 of the inner rail 3 presses the stop blocks 28 of the intermediate rail 2. At this time, the three-stage type slide may have the greatest length. The locking member 33 may be a conventional structure, to prevent the slide from retract due to an unintentional collision or hit.

Figure 6:
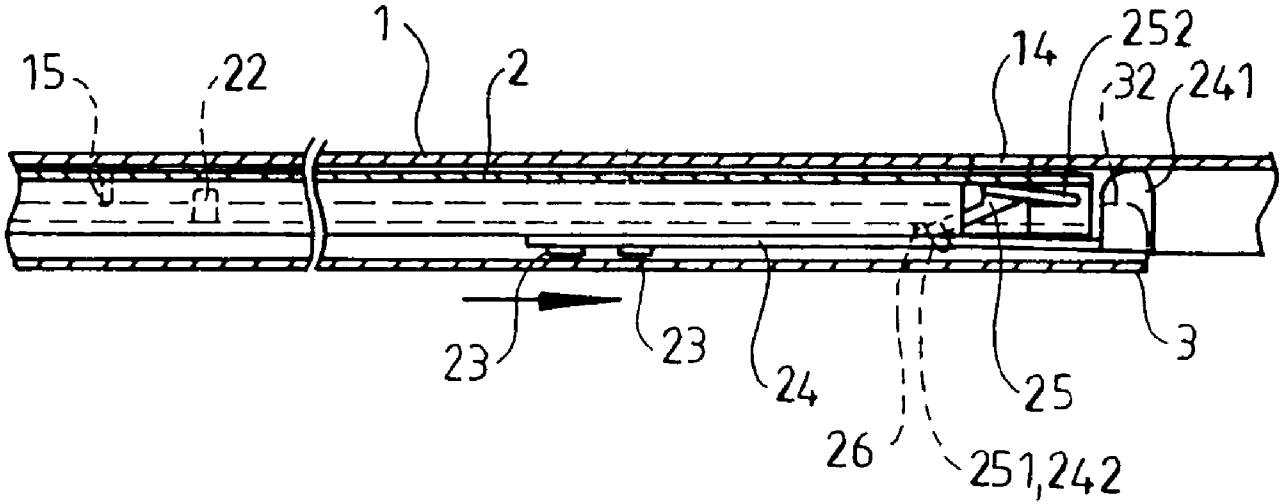
FIG. 6 is a schematic operational view of the rear-section bolt lock structure of a slide as shown in FIG. 5.
Figure 7:
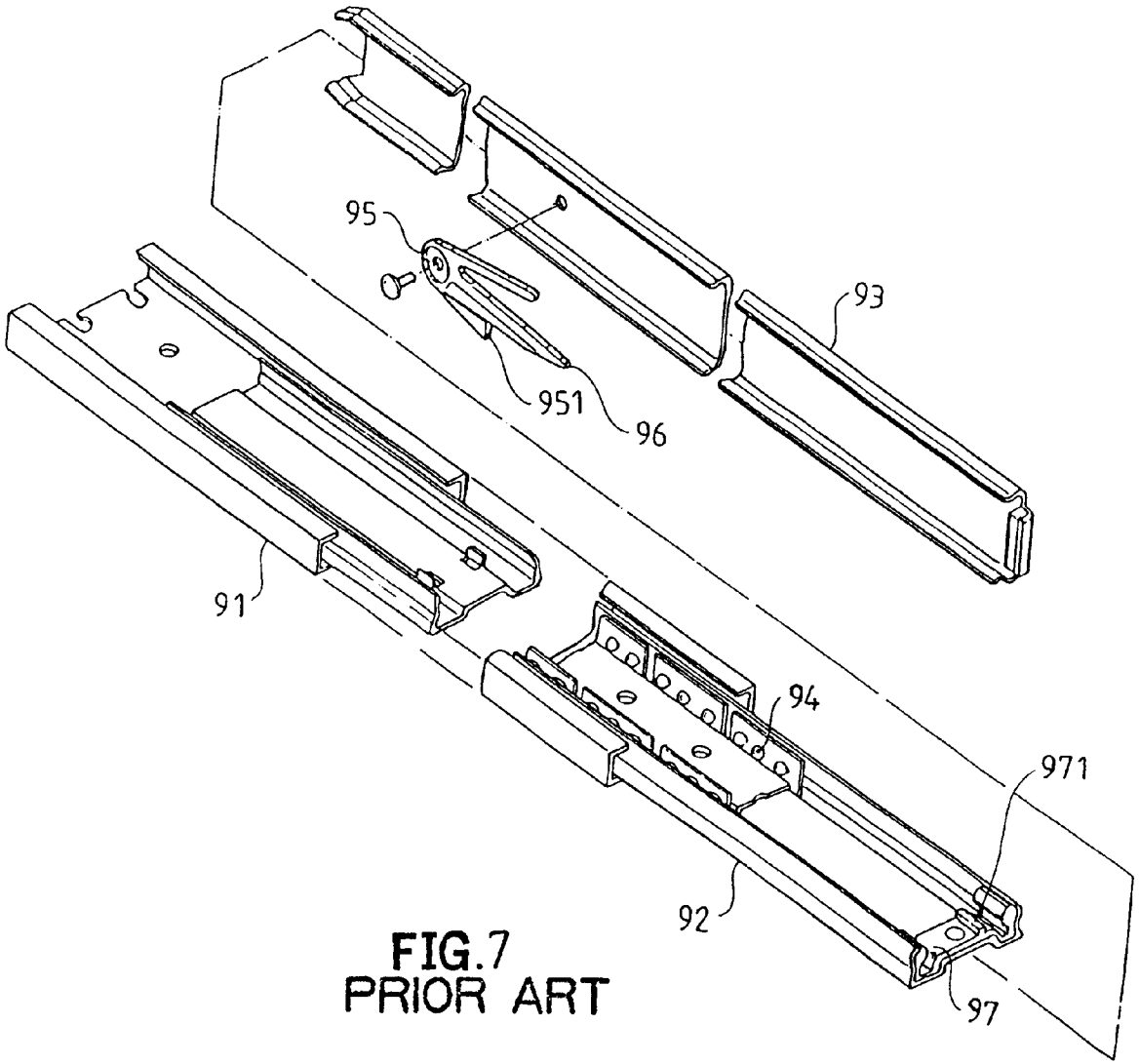
FIG. 7 PRIOR ART
FIG. 7 is an exploded perspective view of a conventional three-stage type drawer slide structure in accordance with the prior art.

Referring to FIG. 6, when the three-stage type slide in accordance with the present invention is to be retracted, the inner rail 3 initially retracts relative to the intermediate rail 2, until the stop end edge 32 of the inner rail 3 presses the wing 252 of the movable plate 25 of the intermediate rail 2. Then, the lug 251 of the movable plate 25 is rested on the positioning plate 24, so that the positioning leg 241 of the positioning plate 24 is detached from the locking hole 14 of the outer rail 1. Thus, the intermediate rail 2 is driven by the inner rail 3, so that the intermediate rail 2 and the inner rail 3 may be retracted into the outer rail 1 simultaneously, until the intermediate rail 2 is rested on the stop plate 13 of the outer rail 1.

Accordingly, in accordance with the rear-section bolt lock structure of a slide of the present invention, when the intermediate rail and the inner rail are pulled to have a greater length, the stop end edge of the inner rail is rested on the wing of the movable plate of the intermediate rail, so that the intermediate rail may be driven to extend at the same time, and may be stopped when the locking block of the intermediate rail is rested on the stop block of the outer rail. Then, the positioning leg of the positioning plate is locked in the locking hole of the outer rail, thereby efficiently forming a positioning bolt lock effect. In addition, when the three-stage type slide in accordance with the present invention is to be retracted, the stop end edge of the inner rail may press the wing of the movable plate of the intermediate rail, whereby the lug of the movable plate may push and lift the positioning plate, so that the positioning leg of the positioning plate is detached from the locking hole of the outer rail. Thus, the intermediate rail may be retracted into the outer rail. Therefore, the three-stage type slide in accordance with the present invention may be pulled and retracted conveniently and easily.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A rear-section bolt lock structure of a slide, comprising:

an outer rail, provided with upper and lower lips, and the outer rail having one end provided with a stop plate, the outer rail provided with locking holes and a stop block;

an intermediate rail, provided with upper and lower lips received and moved in the lips of the outer rail, one end of the intermediate rail provided with a locking block that may be rested on the stop block of the outer rail, the intermediate rail combined with a positioning plate by positioning members, the positioning plate provided with at least one positioning leg that may be locked in the locking hole of the outer rail, a movable plate movably mounted between the intermediate rail and the positioning plate, one end of the movable plate provided with at least one lug that may be locked in at least one locking hole of the positioning plate, the other end of the movable plate provided with at least one wing, the intermediate rail provided with stop blocks; and an inner rail, provided with upper and lower lips received and moved in the lips of the intermediate rail, one end of the inner rail provided with a stop end edge that may press the wing of the movable plate of the intermediate rail, the inner rail provided with a locking member that may rest on the stop blocks of the intermediate rail.

2. The rear-section bolt lock structure of a slide as claimed in claim 1, further comprising a first slide aid member mounted between the outer rail and the intermediate rail, and a second slide aid member mounted between the inner rail and the intermediate rail.

3. The rear-section bolt lock structure of a slide as claimed in claim 1, wherein the movable plate is substantially V-shaped.

* * * * *